United States Patent [19]

Endo

[11] Patent Number: 4,663,558

[45] Date of Patent: May 5, 1987

[54] INCANDESCENT LAMP BULB ASSEMBLY

[75] Inventor: Ariyoshi Endo, Atsugi, Japan

[73] Assignee: Ichikoh Industries Limited, Tokyo, Japan

[21] Appl. No.: 699,920

[22] Filed: Feb. 8, 1985

[30] Foreign Application Priority Data

Feb. 16, 1984 [JP] Japan ..... 59-19798[U]

[51] Int. Cl.[4] ..... H01J 5/48; H01J 5/50

[52] U.S. Cl. ..... 313/318; 313/113; 313/272; 313/316; 313/333; 315/64

[58] Field of Search ..... 313/318, 272, 113, 333, 313/316; 315/64, 67

[56] References Cited

U.S. PATENT DOCUMENTS

| | | | |
|---|---|---|---|
| 3,904,904 | 9/1975 | Meinecke et al. | 313/113 |
| 4,262,228 | 4/1981 | Cruse | 313/113 |
| 4,479,072 | 10/1984 | Gaugel et al. | 313/318 |

*Primary Examiner*—Saxfield Chatmon

*Attorney, Agent, or Firm*—Schwartz, Jeffery, Schwaab, Mack, Blumenthal & Evans

[57] ABSTRACT

An incandescent lamp bulb assembly having three or four lead wires led out of the bottom of a pinched sealing neck of an envelope or bulb containing two filaments (double filament structure), said lead wires are disposed in line longitudinally of the pinched sealing neck. Each of three supports connected to these lead wires comprises a connecting arm section extending parallelly with a plane defined by the line of lead wires and lead-out direction of them and also in a direction intersecting the lead-out direction, and a stem section extending from the connecting arm section and having one end thereof fixed. Since the connecting arm section of each support is so formed as to be welded to a corresponding lead wire from a direction perpendicular to said plane, all the supports are welded to the lead wires from a same direction.

7 Claims, 8 Drawing Figures

INCANDESCENT LAMP BULB ASSEMBLY

BACKGROUND OF THE INVENTION (a) Field of the invention

The present invention relates to a double-filament incandescent lamp bulb assembly, and more particularly to a structure of connecting the lead wires, connected to the filaments, to their respective supports.

(b) Description of the prior art

In case of incandescent lamp bulb assemblies for use as automotive headlights or the like, if provided with two filaments (which will be referred to as "double-filament" type), three or four conductors or wires are led out from the lamp bulb body for connection with an external power source. In the case where three lead wires are provided, the common ends of the two filaments are connected to each other inside the pinched sealing neck of the bulb and further to one of the lead wires for connection to the earth. These lead wires project from the pinched sealing neck as arranged in line in the longitudinal direction of the pinched sealing neck of the bulb. FIG. 1 shows a conventional double-filament type incandescent lamp bulb assembly with an arrangement of four lead wires 2*a*, 2*b*, 2*c* and 2*d* in line. For the simplicity of illutration and explanation, the two filaments are not shown in the Figure; in practice, however, the lead wires 2*a* and 2*d* are connected to the main filament, while the other lead wires 2*b* and 2*c* are connected to the sub-filament. These lead wires are fixed with respect to the terminals 3*a*, 3*b* and 3*c* (shown each with a small circle for simplicity of illustration) provided on a holder or reflector 3. The lead wires 2*a* and 2*b* are provided corresponding to a common negative-polarity terminal 3*a*, lead wire 2*c* is to a positive-polarity terminal 3*c* for the sub-filament, and the lead wire 2*d* is provided corresponding to a terminal 3*d* for the main filament, respectively.

For electric continuity by the above connections, the lead wires 2*a* and 2*b* are welded to a support 4*a*, the lead wire 2*c* to a support 4*c*, and the lead wire 2*d* to a support 4*d*, respectively, as shown in FIG. 2. Further, these supports 4*a*, 4*c* and 4*d* are installed to their respective terminals 3*a*, 3*b* and 3*d* of the holder or reflector 3 for electric continuity, while the bulb 1 is supported to the holder or reflector 3. The reference numeral 5 shows a plate in which the pinched sealing neck 1*a* of the bulb 1 is fitted, and the plate 5 is fixed to the holder 3.

FIG. 3 is an exploded perspective view of the above-mentioned conventional incandescent lamp bulb. In this Figure, the lead wires 2*a* to 2*d* are cut to appropriate lengths, respectively, and the plate 5 is fitted on the pinched sealing neck 1*a* of the bulb 1, the lead wires 2*a* and 2*b* have their ends spot-welded to the upper portion of the support 4*a*, the lead wire 2*c* has the end to that of the support 4*c*, and the lead wire 2*d* has the end to that of the support 4*d*, respectively.

The above-mentioned three supports 4*a*, 4*c* and 4*d* are each formed like an L-shaped lever.

For definite contrast with the embodiment according to the present invention, which will be described later, three orthogonal axes are assumed here as shown in FIG. 3. The Z-axis is directed parallel with the lead wires 2*a* to 2*d*, X-axis is in line with the lead wires 2*a* to 2*d*, and the Y-axis is directed perpendicularly to both the X- and Z-axes.

The supports 4*a* and 4*d*, among the three L-shaped supports 4*a*, 4*c* and 4*d*, which are welded to the lead wires at both extremities, consist of an X-axial connecting arm section and a Z-axial rising section, respectively. The connecting arm sections are opposed to each other and spot-welded to their associated lead wires.

FIG. 4 is a bottom view of the structure in FIG. 2. The connecting arm section (X-axial) of the support 4*a* is abutted on the lead wires 2*a* and 2*b*. The connecting arm section is spot-welded to the lead wires 2*a* and 2*b* with them forced in the directions of arrow a and a′ along the Y-axis.

The connecting arm section (X-axial) of the support 4*d* is abutted to the lead wire 2*d*, and spot-welded to the latter with them forced in the directions of arrows d and d′ along the Y-axis.

However, the support 4*c* to be welded to the central lead wire 2*c* has the connecting arm section directed nearly along the Y-axis. Therefore, this support 4*c* must be spot-welded to the lead wire 2*c* with force in the directions of arrows c and c′ generally parallel with the X-axis.

As apparent from the illustration given in FIG. 4, if the lead wire 2*c* and support 4*c* are to be spot-welded to each other as forced in the directions of arrows c and c′, the spot-welding encounters a difficulty because there is only a narrow space between the area to be welded and adjacent lead wires. In addition, the lead wire 2*c* and support 4*c* must be forced to each other in the Y- and X-axial directions, which will complicate the working procedure. Namely, the automatization of the above working procedure, if tried, will necessitate a large, complicate automatic welding machine which requires a large equipment cost and running cost.

SUMMARY OF THE INVENTION

It is, therefore, an object of the present invention to provide an incandescent lamp bulb assembly which needs only a simple procedure of connecting, to the supports, the lead wires connected to the two filaments, said bulb assembly being of a structure permitting an easy connection between the lead wires and supports.

The above object is accomplished by providing, according to the present invention, an incandescent lamp bulb assembly of a structure which permits an easy welding three or four lead wires led out of an envelope or bulb containing two filaments to their associated three conductive supports, respectively.

The lead wires are led out as disposed nearly in line longitudinally of the pinched sealing neck of the bulb. The supports to be connected to the lead wires comprise each, at least, a connecting arm section formed in a direction parallel with a plane defined by the line, and the lead-out direction, of the lead wires, and which intersects the lead-out direction of the lead wires, and a stem section extending from the connecting arm section and which has one end to be fixed. Since each connecting arm section is so formed as to be welded to a corresponding lead wire from a direction perpendicular to the plane defined by the line-arranged direction, and the lead-out direction, of the lead wires, all the supports can be welded to their associated lead wires from a same direction.

BRIEF DESCRIPTION OF THE DRAWINGS

FIG. 1 being a schematic perspective view showing the direction of lead-out from the lamp bulb, and the arrangement, of the lead wires connected to the filaments;

FIG. 2 being also a schematic perspective view showing the connection between the lead wires and supports;

FIG. 3 being an exploded view of the bulb shown in FIG. 2; and

FIG. 4 is a bottom view of the bulb in FIG. 2;

FIG. 5 showing a schematic perspective view showing the relation between the lead wires and supports to be connected, with the filaments not shown;

FIG. 6 being also a schematic perspective view showing the state of the lead wires and supports connected together;

FIG. 7 being a view, partially enlarged in scale, of FIG. 6; and

FIG. 8 being a bottom view of the bulb shown in FIG. 6.

DETAILED DESCRIPTION OF THE PREFERRED EMBODIMENT

Figure 1:
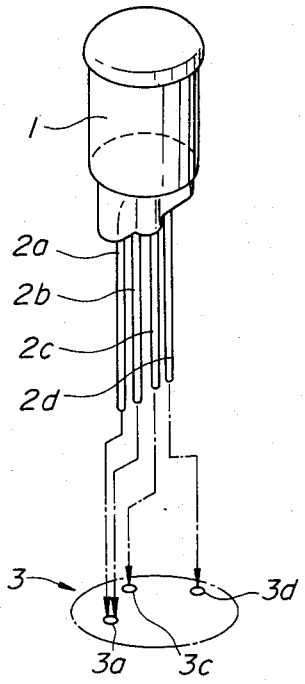
FIG. 1 (PRIOR ART)
FIGS. 1 thru 4 show the structure of a conventional incandescent lamp bulb assembly.
Figure 2:
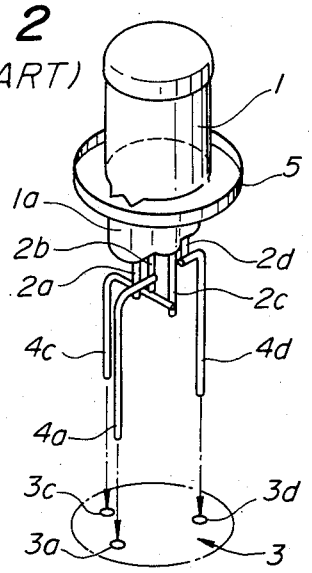
FIG. 2 (PRIOR ART)
Figure 3:
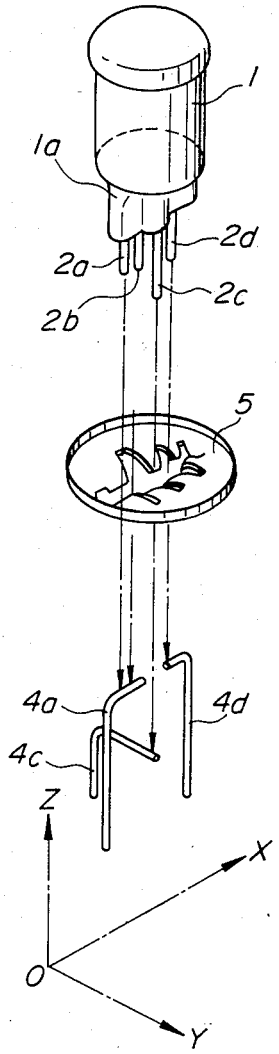
FIG. 3 (PRIOR ART)
Figure 5:
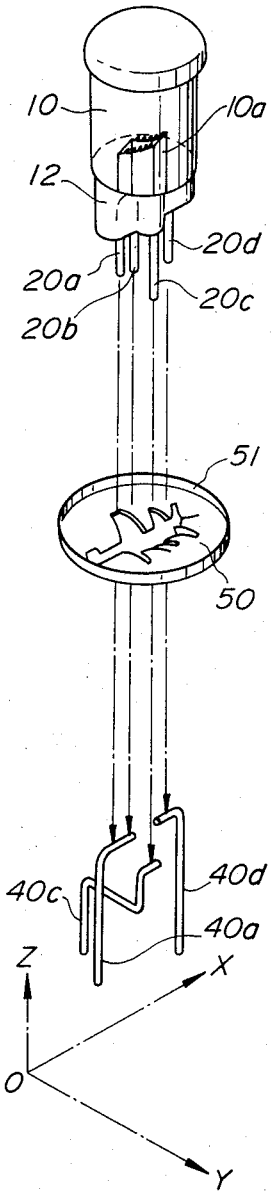
FIGS. 5 thru 8 show one embodiment of the incandescent lamp bulb according to the present invention.
Figure 4:
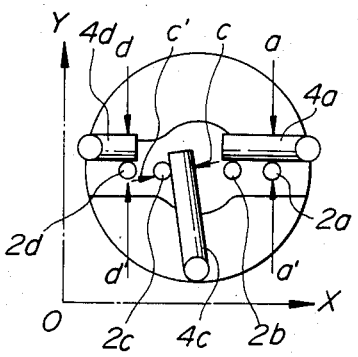
FIG. 4 (PRIOR ART)
Figure 6:
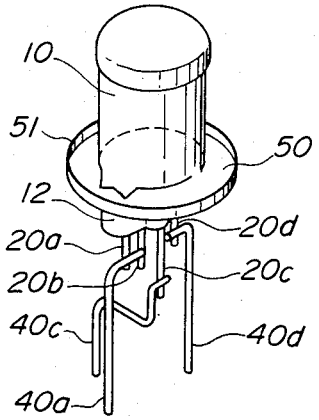
Figure 7:
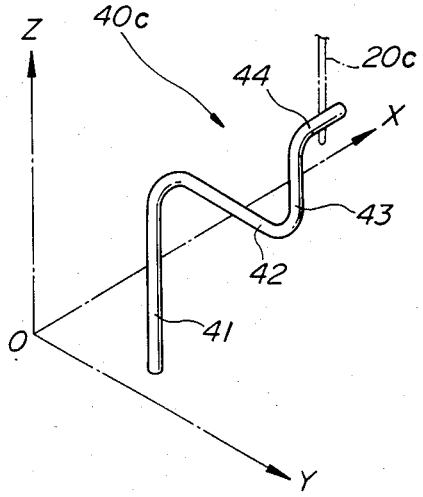

Through FIGS. 5 thru 8, the reference numeral 10 denotes an incandescent lamp bulb body. The incandescent lamp in this embodiment is preferably an incandescent halogen lamp having two filaments 10*a*, main and sub, as shown in FIG. 5, connected at the terminals thereof to lead wires 20*a*, 20*b*, 20*c* and 20*d*. The main filament has the opposite ends thereof connected to the lead wires 20*a* and 20*d*, respectively. The lead wires 20*a* to 20*d* are projected out of a pinched sealing neck 12 of the bulb body 10 as arranged in line along the longitudinal direction of the neck 12. For the convenience of illustration, the direction in which the lead wires 20*a* to 20*d* are arranged in line is taken as X-axial direction, the direction in which the lead wires are projected is as Z-axial direction, and the direction perpendicular pendicular to both the X- and Z-axial directions is as Y-axial direction.

The bulb body 10 has the pinched sealing neck 12 fixed to a fixture such as holder or reflector (not shown) as fitted in the cut in a retainer 50. In this embodiment, the fixture is a holder. The retainer 50 has a circumferential edge 51 raised nearly vertically so as to be fixed to the inner wall of the upper portion of the above-mentioned holder.

Figure 8:
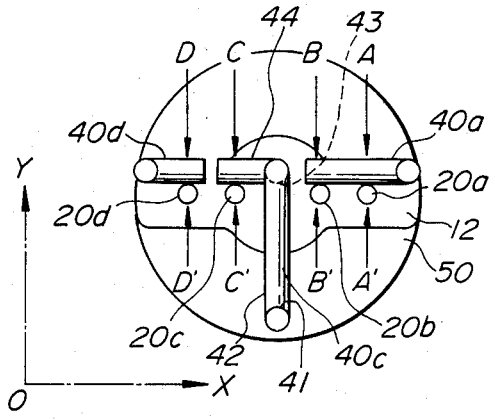

The lead wires 20*a* and 20*b* are led out of the bulb body 10 and connected to a support 40*a*. Similarly, the lead wires 20*c* and 20*d* are connected to supports 40*c* and 40*d*, respectively. The supports 40*a* and 40*d* are generally L-shaped so that each of these supports consists of a stem section extending in the Z-axial direction and a connecting arm section extending from the stem section nearly perpendicularly to the X-axial direction. Each stem section has the lower end which is to be fixed to the bottom of the holder or reflector after connection to the lead wires, which will be described later. As shown in FIG. 5, the connecting arm sections are disposed opposite generally in line to each other so that a plane is defined by each stem section and connecting arm section. On the other hand, the support 40*c* has a stem section 41 extending perpendicularly to the X-axial direction, a horizontal section 42 extending from the top end of the stem section in the Y-axial direction, a vertical section 43 extending from the end of the horizontal section 42 in a direction perpendicular to the Y-axial direction, and a connecting arm section 44 extending X-axially from the upper end of the vertical section 43. Similarly to the supports 40*a* and 40*d*, the lower end of the stem section 41 is fixed to the bottom of the holder or reflector after connection with the lead wire 20*c*, except that it is fixed in a place away from a straight line connecting the supports 40*a* and 40*d* as shown in FIG. 8. These fixing points are so located as to form, on the holder or reflector, a triangle with the fixing point of the support 40*c* taken as apex. The horizontal section 42 extends from the upper end of the stem section 41 so as to be perpendicular to the above-mentioned plane, while the vertical section 43 extends nearly in this plane. The connecting arm section 44 extends in the above-mentioned plane similarly to the vertical section 43.

Each of the above-mentioned lead wires uses a nickel wire of about 1 mm in diameter, and each support uses a nickeled soft copper wire of approximately 1.5 mm in diameter.

The lead wires 20*a* to 20*d* are connected to their associated supports, respectively, by spot-welding. The lead wires 20*a*, 20*b* and 20*d* have a nearly same length, and the lead wire 20*c* has a little larger length than the other ones.

As shown, the supports 40*a* and 40*d* are held with their upper ends opposite to each other, and the supports are disposed at the same side of the lead wires so that the support 40*a* will have the connecting arm section thereof being in contact with the lead wires 20*a* and 20*b* while the support 40*d* will have the connecting arm section thereof being in contact with the lead wire 20*d*. In this state, both the electrodes of a spot welder are abutted to the lead wires and supports, respectively, in the direction of arrows A and A', B and B' and D and D', namely, Y-axially, in FIG. 8, to weld the lead wires 20*a* and 20*b*, and 20*d* to the connecting arm sections of the supports 40*a* and 40*d*, respectively.

In case the support 40*c* is welded to the lead wire 20*c*, the connecting arm section 44 of the support 40*c* is positioned in a place lower than the connecting arm sections of the supports 40*a* and 40*d* and where it is in a plane defined by the supports 40*a* and 40*d*, and then the support 40*c* is welded to the lead wire 20*c* by abutting both the electrodes of the spot welder in the directions of arrows C and C', namely, Y-axially, on one another.

In case of the inventive halogen lamp bulb for headlight, all the connecting arm sections of the supports are disposed in the direction along which the lead wires are arranged, and abutted on the sides of all the corresponding lead wires. The lead wires and supports can be welded to each other simultaneously by abutting them on each other in a same direction perpendicular to a plane defined by the line of the lead wires and the lead-out direction of them. That is, after the connecting arm section of each support is disposed in a predetermined position with respect to each lead wire, they can be spot-welded to each other simultaneously by a single welding operation. Thus, the supports can be connected to the lead wires simultaneously in a single welding procedure, which greatly simplifies the working procedure and considerably improves the working efficiency.

Particularly, since the support 40*c* is so formed that the direction in which the support 40*c* and lead wire 20*c* are abutted on each other will be perpendicular to a plane defined by the line of the lead wires and lead-out direction of them, the adjacent lead wires 20*b* and 20*d* are not any hindrance against the welding. Far from it, the welding operation is facilitated owing to this arrangement. This also means that it will facilitate any other procedure of joining the supports and the lead wires than spot-welding. Furthermore, since the support 40*c* has a horizontal section 42 positioned lower than the connecting arm section 44 and which is formed contiguously to the vertical section 43, the horizontal section 42 will not interfere with spot-welding.

In the previously-mentioned embodiment, the vertical section 43 and horizontal section 42 are formed contiguously to each other between the connecting arm section 44 and the stem section 41 of the support 40*c*. However, it is obvious to those skilled in the art that the connecting arm section and stem section may be connected to each other by means of a continuous intermediate section of a three-dimensional shape.

Also, the vertical section 43 is not always required; the support 40*c* may be formed by a stem section 41, a horizontal section extending from the upper end of the stem section in the Y-axial direction, and a connecting arm section 44 extending from the end of the horizontal section in a direction parallel with a plane defined by the leadout direction, and the line, of the lead wires and which intersects the lead-out direction of the lead wires.

Also, the supports 40*a* and 40*d* are nearly L-shaped in the previously-mentioned embodiment; however, the shape of these supports is not limited to the L-shape. It suffices that the connecting arm sections are formed at least in a direction parallel with the plane defined by the line of the lead wires and the lead-out direction of the lead wires and which intersects the lead-out direction of the lead wires, so that the stem sections are connected to one end of the connecting arm sections.

The embodiment having been described in the foregoing concerns a halogen lamp bulb with four lead wires led out of the pinched sealing neck; however, in case three lead wires of two filaments are led out of the pinched sealing neck, the lead wire 20*a* is connected to the support 40*a*, lead wire 20*c* is connected to the support 40*c* and the lead wire 20*d* is connnected to the support 40*d*. This arrangement will further simplify the connecting procedure. Also, the position where the lower end of each support is fixed should not be limited to the bottom of the holder to which the bulb body is directly supported. The lower ends of the supports may be fixed to the bottom of the reflector as the case may be.

What is claimed is:

1. An incandescent lamp bulb for use as headlight, comprising:

an envelope containing two filaments;

four lead wires lead out of the bottom of a pinched sealing neck of said envelope, said lead wires led out as disposed nearly in line longitudinally of said pinched sealing neck;

three conductive supports connected to said lead wires, respectively, to supply a current to said filaments through said lead wires, said supports including a first support connected to the one of said lead wires which is located at one extremity and the lead wire adjacent to this lead wire, a second support connected to the lead wire at the other extremity, and a third support connected to the remaining lead wire, each of said supports comprising, at least, a connecting arm section formed parallelly with a plane defined by the line, and the lead-out direction, of said lead wires and also in a direction intersecting said lead-out direction, and a stem section extending from said connecting arm section and having one end thereof fixed, each of said supports having the connecting arm section welded to a corresponding lead wire in the directions perpendicular to said plane.

2. An incandescent lamp bulb according to claim 1, in which:

each of said connecting arm sections is parallel with said plane and also perpendicular to said lead-out direction of lead wires.

3. An incandescent lamp bulb according to claim 1, in which:

said connecting arm sections are joined to corresponding lead wires at a same side.

4. An incandescent lamp bulb according to claim 1, in which:

said first and second supports have each a stem section extending in a direction parallel with said lead-out direction of lead wires and said third support has a stem section extending in a direction parallel with said lead-out direction of lead wires and which has an end fixed to said remaining lead wire at a point offset from a straight line connecting the fixed ends of said first and second supports, said third support further having an intermediate section connecting said stem section and connecting arm section to each other.

5. An incandescent lamp bulb according to claim 4, in which:

the intermediate section of said third support consists of a first intermediate section extening from the upper end of said stem section in a direction perpendicular to said plane, and a second intermediate section extending from one end of said first intermediate section in a direction parallel with said lead-out direction of lead wires and also connected with said connecting arm section.

6. An incandescent lamp bulb according to claim 5, in which:

the connecting arm section of said third support is lower than those of said first and second supports.

7. An incandescent lamp bulb for use as headlight, comprising:

an envelope containing two filaments;

three lead wires connected to said filaments and led out of the bottom of a pinched sealing neck of said envelope, said lead wires being led out as disposed nearly in line longitudinally of said pinched sealing neck;

three conductive supports connected to said lead wires to supply a current to said filaments through said lead wires, each of said supports comprising, at least, a connecting arm section formed parallelly with a plane defined by the line, and the lead-out direction, of said lead wires and also in a direction intersecting said lead-out direction, and a stem section extending from said connecting arm section and having the one end thereof fixed, each of the connecting arm sections of said supports being welded to a corresponding lead wire in the directions perpendicular to said plane.

* * * * *